US005896995A

United States Patent [19]

Murray et al.

[11] Patent Number: 5,896,995

[45] Date of Patent: Apr. 27, 1999

[54] PALLET-BASED CONVERTIBLE SHIPPING CONTAINER AND DISPLAY STAND AND METHOD

[76] Inventors: James Murray, 4120 Jersey Pike, Chattanooga, Tenn. 37421; Stephen M. Fuller, 1241 Thomas La., Hixson, Tenn. 37343; Stewart B. Bickley, 202 W. Watkins, Lookout Mountain, Tenn. 37350; Jerry N. Cunningham, 609 S. Palisades, Signal Mountain, Tenn. 37377; Robert Bower, 170 SE. Crescent Dr., Cleveland, Tenn. 37323

[21] Appl. No.: 08/999,255

[22] Filed: Dec. 29, 1997

[51] Int. Cl.[6] ..... B65D 5/52

[52] U.S. Cl. ..... 206/736; 206/386

[58] Field of Search ..... 206/386, 586, 206/597, 600, 735, 736, 766

[56] References Cited

U.S. PATENT DOCUMENTS

| | | | |
|---|---|---|---|
| 4,049,113 | 9/1977 | Joyce et al. | 206/804 |
| 4,454,946 | 6/1984 | Yokowo | 206/600 |
| 4,697,699 | 10/1987 | Schneider | 206/44.11 |
| 4,705,162 | 11/1987 | Kupersmit | 206/45.11 |
| 4,718,545 | 1/1988 | Chrzanowski et al. | 206/45.15 |
| 4,809,847 | 3/1989 | Schneider | 206/45.31 |
| 4,907,693 | 3/1990 | Child | 206/44 R |
| 4,913,290 | 4/1990 | DeGroot | 206/386 |
| 5,035,323 | 7/1991 | Daniels | 206/386 |
| 5,161,692 | 11/1992 | Knierim | 206/586 |
| 5,249,669 | 10/1993 | Resnick et al. | 206/45.15 |
| 5,251,753 | 10/1993 | Pigott et al. | 206/586 |
| 5,293,991 | 3/1994 | Neumann et al. | 206/45.12 |
| 5,392,985 | 2/1995 | Smith et al. | 529/125 |
| 5,441,154 | 8/1995 | Youell, III | 206/386 |
| 5,450,965 | 9/1995 | Cox | 206/597 |
| 5,465,831 | 11/1995 | Smith | 206/44 R |
| 5,704,488 | 1/1998 | Smith | 206/386 |

*Primary Examiner*—David T. Fidei
*Attorney, Agent, or Firm*—Miller & Martin LLP

[57] ABSTRACT

A pallet-based shipping container and display stand is disclosed which is free-standing and generally square in shape. The container comprises a pallet base, a lower tray, a medial divider within the tray and a plurality of boxes stacked on either side of the divider within the tray. The divider has one or more packaging containers to hold packaging which can be used by consumers. In the shipping configuration, the container is braced and topped with a cap. In the display configuration, the cap is removed and discarded and a display board erected in the divider. A method of shipping and displaying small products using a pallet-based shipping container and display stand.

19 Claims, 4 Drawing Sheets

PALLET-BASED CONVERTIBLE SHIPPING CONTAINER AND DISPLAY STAND AND METHOD

BACKGROUND OF THE INVENTION

The present invention relates to shipping containers and display stands formed primarily from foldable sheet material such as paperboard or corrugated board to hold and to display packages of merchandise. The present invention also includes a method of shipping and displaying small products.

The expenses associated with shipping and displaying small retail products that are typically sold in supermarkets, drug stores and similar retail operations are a significant part of the overall cost of merchandising such products. Therefore, there is a need for improved methods of shipping and displaying such products, such as food and candy. Display stands formed from foldable sheet material such as paperboard or corrugated board are well known for use in the shipment and display of merchandise items for sale in retail outlets. Such strands are quite versatile in that they can be designed to accommodate the needs of a particular product. Also these display stands are relatively inexpensive so that they can be discarded or recycled after they have served their purpose for the shipment, display and promotion of the selected product or merchandise.

SUMMARY OF THE INVENTION

The present invention is a single-unit pallet-based convertible shipping container and display stand having a unique combination of features that are especially suited to economical shipment and display of a large assortment of relatively heavy products. The shipping container is formed as a single unit including a pallet base which is quickly convertible from the shipping configuration into a configuration for the simultaneous display of multiple types of small, relatively heavy products.

In the present invention, the displayed products are preferably food products of single or small serving sizes, such as individually packaged candies. A pre-selected variety of such products are displayed within a number of open packages or boxes, each containing a number of individual products. The invention also includes one or more packaging containers for presenting additional packaging to consumers so that the consumers may select and package for themselves a desired selection of the individual products.

The invention also includes a centrally located stabilizing member which serves to strengthen and add stability to the shipping container and display stand during both shipping and display.

The invention also includes a detachable header device which may be packed unassembled during shipment for supporting graphic display materials concerning the products on display. Finally, the invention includes a number of peripheral panels which may be positioned during shipment to assist in maintaining the structural stability of the shipping container and then positioned as a skirt in the display configuration to hide the pallet from view and provide improved appearance for the display stand. The invention thus provides an inexpensive, disposable and recyclable container suitable for shipment which also decreases the labor necessary at the final destination to prepare the product for display and sale.

It is, therefore, a principal object of the present invention to provide a product shipping and storage unit which can be conveniently and simply converted into a retail display stand.

It is a further object of the invention to provide a disposable, single unit shipping container formed from foldable sheet material such as corrugated board having a pallet base which allows convenient movement of the shipping container by forklift and also provides a flexible retaining wall which alternately provides support during shipment and a pleasant appearance in the display configuration.

It is a further object of the invention to provide a merchandise display stand upon which a plurality of individually sized products and packaging therefor are displayed in close proximity for ease of selection by the consumer.

It is a further object of the present invention to provide a display stand having sufficient strength in its components to provide support for the weight of the products being displayed.

It is a further object of the invention to provide a shipping container and display stand with a central stabilizing member to reinforce the stability of the invention in both the shipping and display configurations.

It is also an object of the present invention to provide a number of packaging containers for presenting additional packaging to a consumer so that the consumer may select and package for himself or herself a desired selection of the products being displayed.

It is a further object of the present invention to provide a header device for supporting graphic display materials concerning the products on display.

These and other objects, advantages and applications of the present invention will become apparent to those skilled in the art when the accompanying description of the preferred embodiment of the present invention is read in conjunction with the accompanying drawings.

DETAILED DESCRIPTION OF THE DRAWINGS

Figure 1:
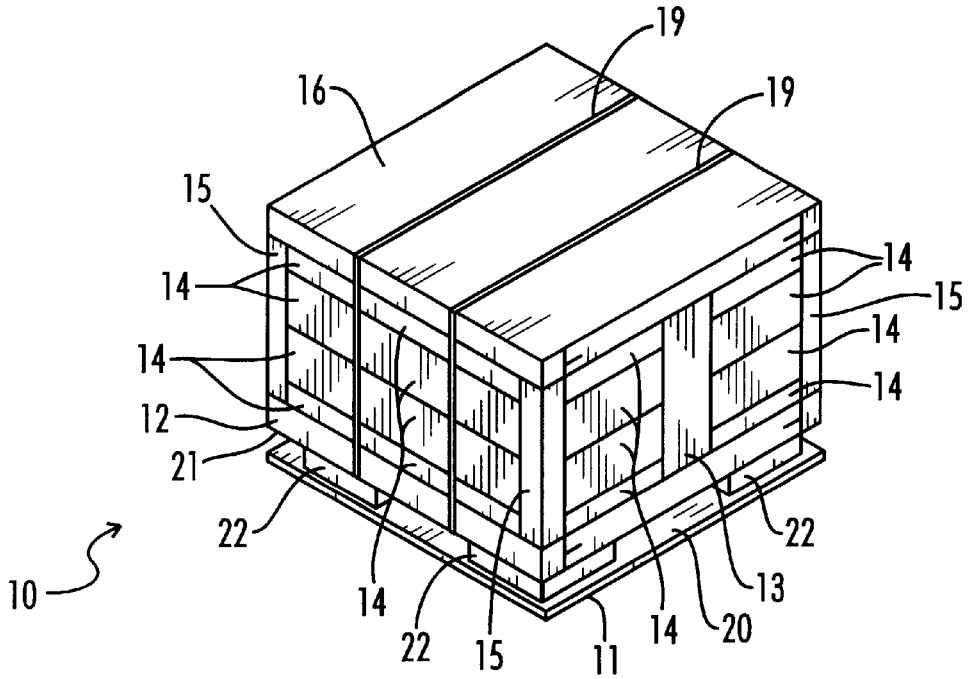
FIG. 1 is a perspective view of the shipment configuration of the convertible shipping container and display stand of the present invention.

Referring now to the drawings and in particular to FIG. 1, a perspective view of the pallet-based convertible shipping container and display stand 10 of the present invention is shown in the shipment configuration. The container 10 comprises a base 11, a lower tray 12 atop the base 11, a medial divider 13 recessed within the lower tray 12, a plurality of boxes 14 in stacked, side-by-side relation within the lower tray 12 on both sides of the divider 13, a plurality of disposable corner braces 15 inserted in the corners of the lower tray to retain the boxes 14, a detachable header device (shown in FIGS. 5 and 6), and a rimmed cap 16 atop boxes 14, divider 13 and braces 15. In the preferred embodiment of the present invention, base 11, lower tray 12, divider 13, boxes 14, braces 15 and cap 16 are each constructed of corrugated paperboard, with the sturdiness and grade of the paperboard for each component varying depending upon the desired structural characteristics of each component. During shipment, it is preferable that the container 10 be bound, such as by wire binding 19, straps or plastic wrap (not shown).

Figure 5:
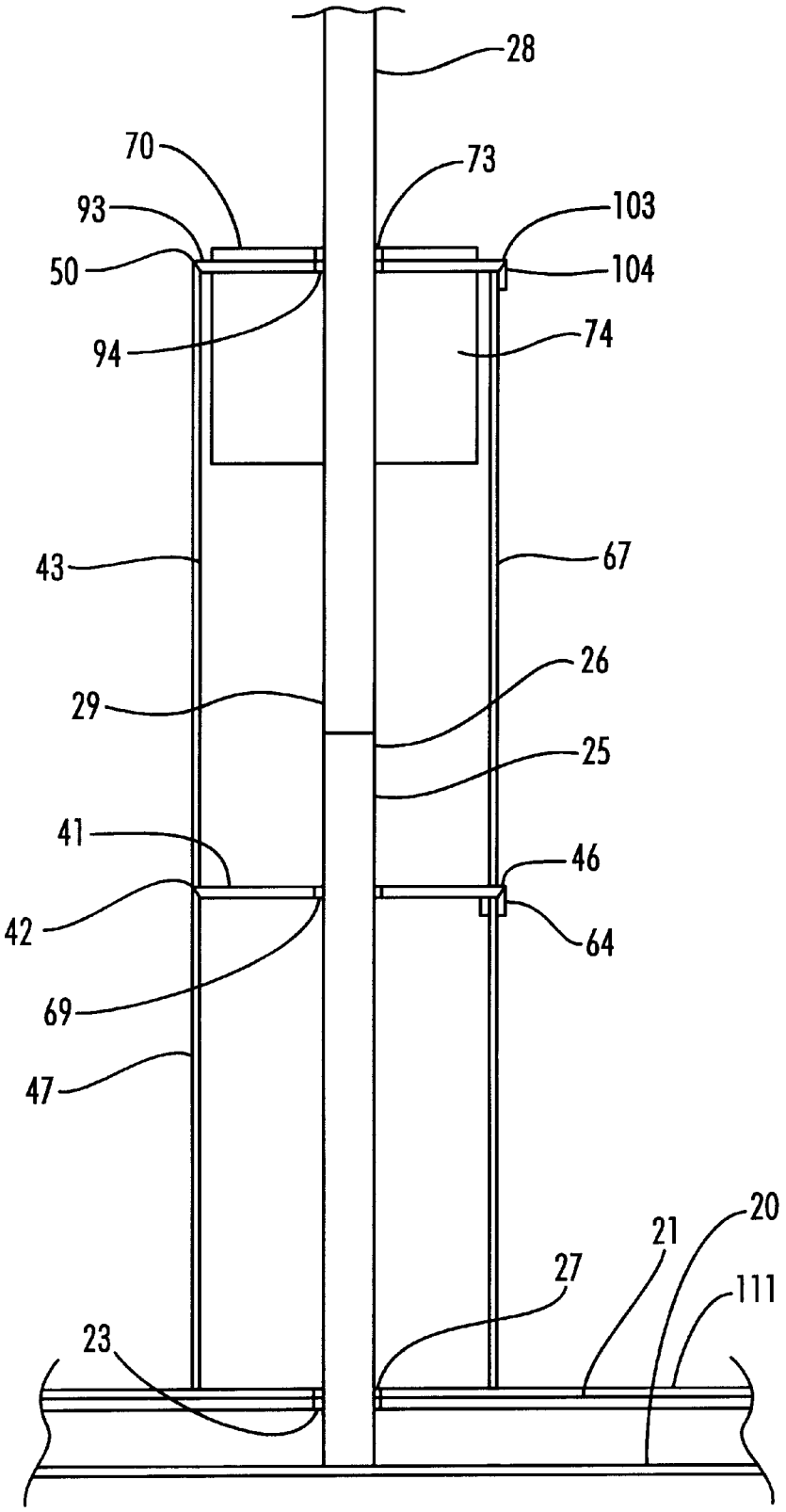
FIG. 5 is a side cross-section view of the medial divider and support tube of the present invention.

Base 11 preferably comprises a pallet, allowing the shipping container 10 to be lifted by a forklift or other similar lifting device. In such a configuration, base 11 may be comprised of a lower deck 20 and an upper deck 21 joined by a plurality of spacers such as cores 22. Spacers are attached to upper deck 21 and lower deck 20 through any method of attachment common in the art, though use of an adhesive such as glue is preferred. Upper deck 21 has a centrally located hole 23 (shown in FIG. 5) sized to receive the support pole 25 (as shown in FIG. 5).

Figure 2:
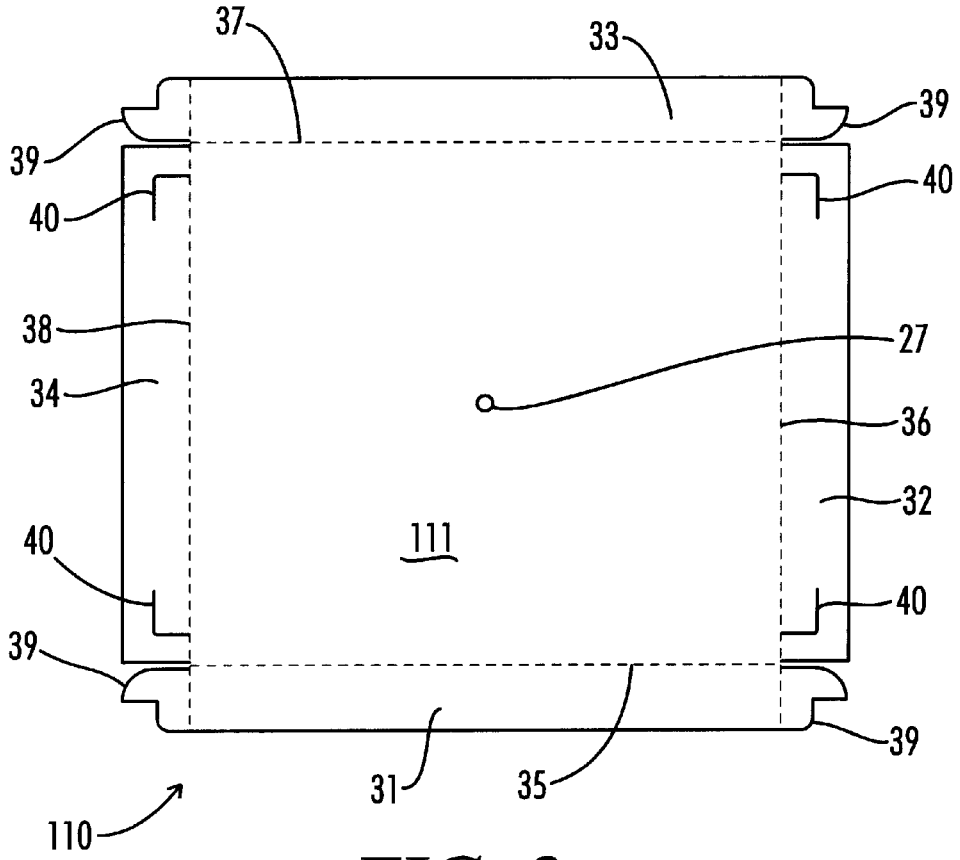
FIG. 2 is a top plan view of a lower tray blank from which both the lower tray and cap of the present invention may be formed.

Turning then to FIG. 2, a lower tray blank 110 of foldable sheet material is shown from which both the lower tray 12 and disposable cap 16 of the present invention may be formed. Lower tray blank 110 includes a main panel 111 which is substantially the same size as upper deck 21 of base 11 (shown in FIG. 1) and peripheral panels 31, 32, 33, 34 foldably connected to side-edges 35, 36, 37, 38, respectively, of main panel 111. Adjacent peripheral panels 31, 32, 33, 34 have joining members, such as tabs 39 and slits 40, which releasably connect with cooperating joining members on adjacent peripheral panels when the peripheral panels are folded at right angles relative to main panel 111. Thus, it can be seen that when peripheral panels are joined in the upright position as shown in FIG. 1, a retaining wall is formed which prevents the shifting of the divider 13 and boxes 14 during shipment and also holds the braces 15 in place.

The lower tray blank 110 used to form lower tray 12 is affixed atop upper deck 21 of base 11 using any common method of attachment, though again, use of an adhesive such as glue is preferred.

An identical lower tray blank 110 may be used to form the disposable cap 16 (shown in FIG. 1) of the present invention.

As shown in FIG. 2, main panel 111 of lower tray blank 110 also has a centrally located hole 27 sized to receive support pole 25 (as shown in FIG. 5). As shown in FIG. 5, hole 27 aligns with hole 23 in upper deck 21 when lower tray 12 is joined to upper deck 21.

Figure 6:
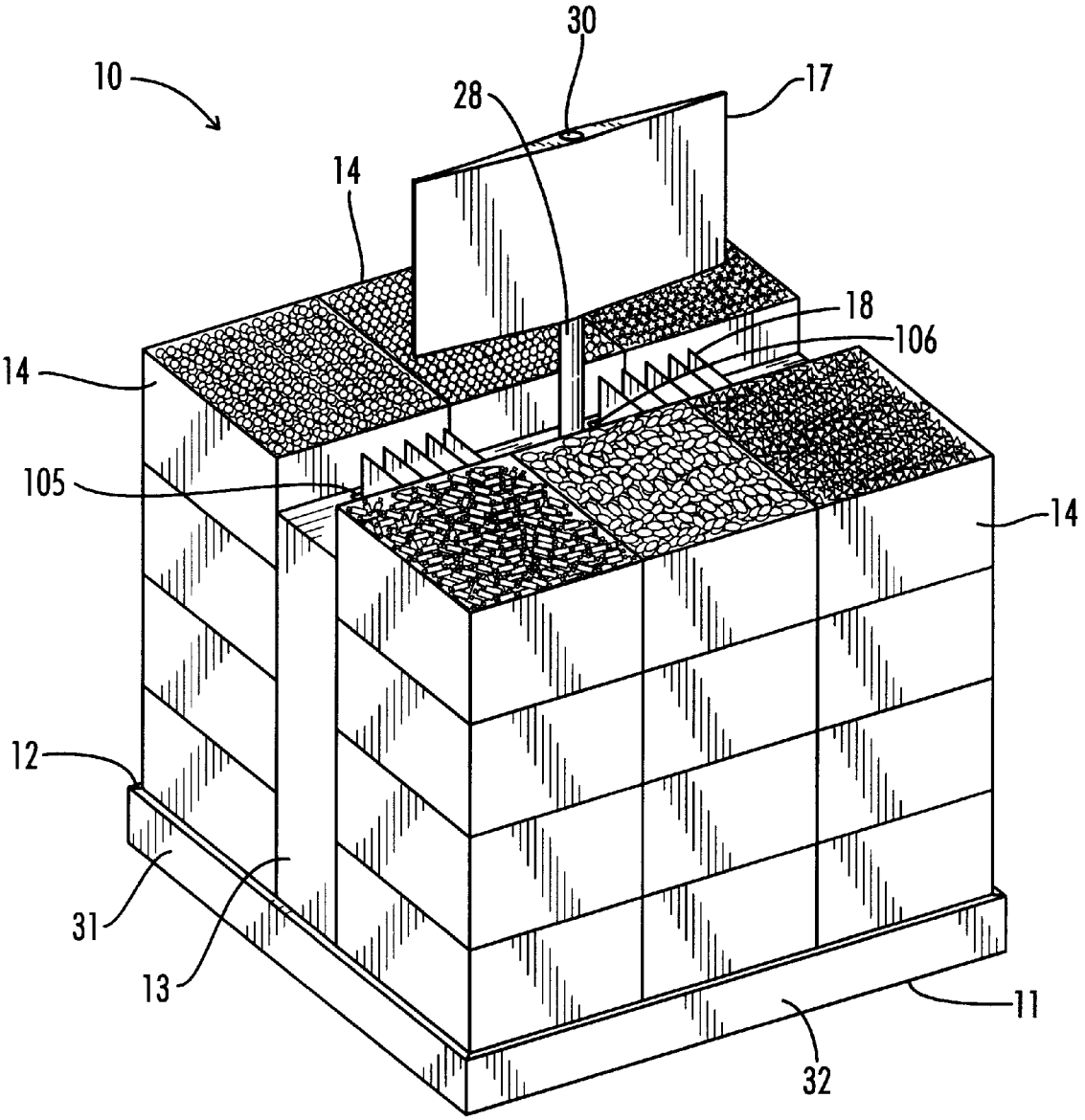
FIG. 6 is a perspective view of the display configuration of the convertible shipping container and display stand of the present invention.

As shown in FIG. 6, when the retaining wall, or more precisely the peripheral panels 31, 32, 33, 34 forming the retaining wall, are folded in a downward position relative to lower tray 12, a skirt concealing base 11 from view is formed.

Figure 3:
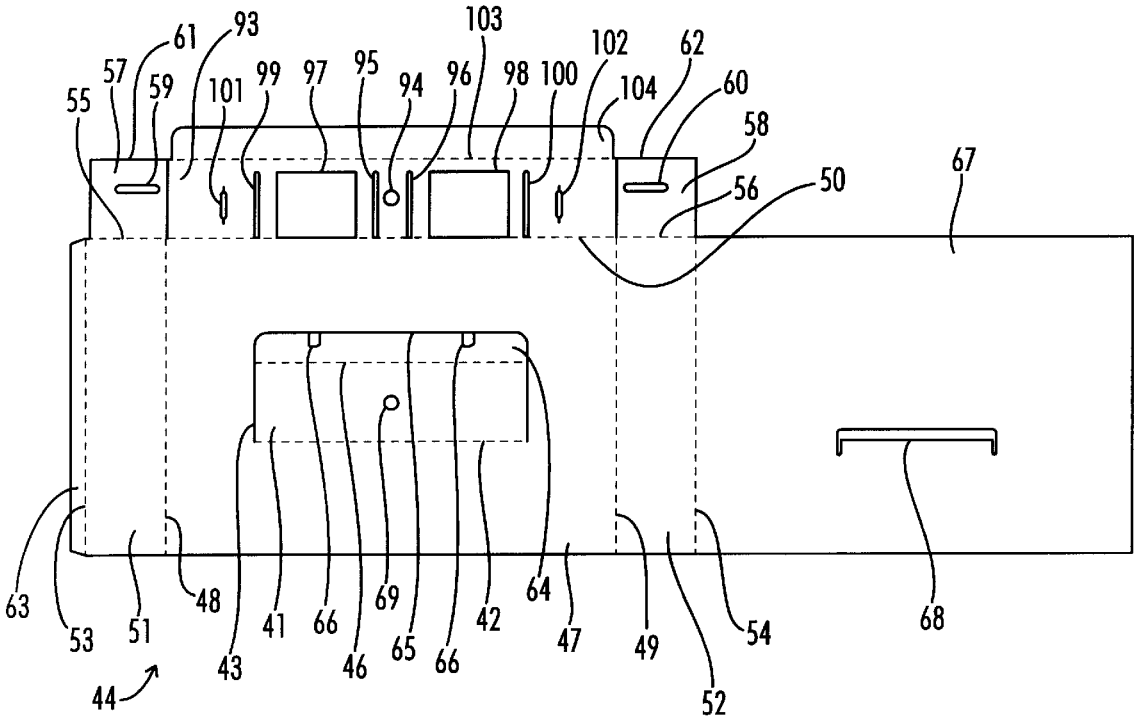
FIG. 3 is a top plan view of a divider blank of the present invention.
Figure 4:
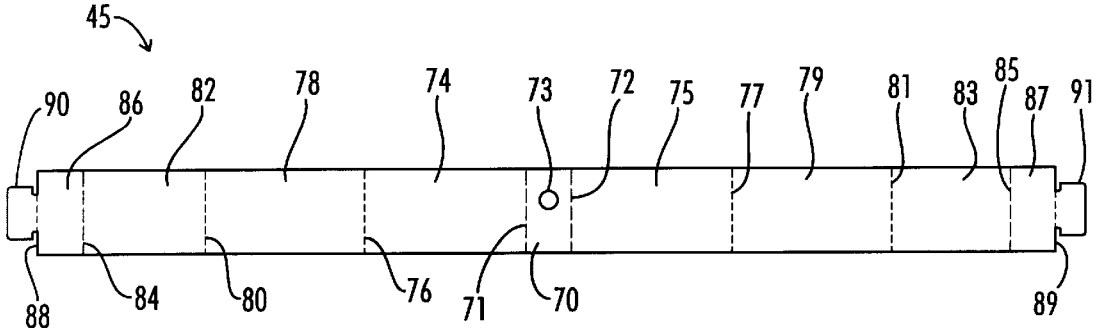
FIG. 4 is a tube support blank of the present invention.

Turning then to FIGS. 3 and 4, divider blank 44 and tube support blank 45 are shown. Both divider blank 44 and tube support blank 45 are comprised of foldable sheet material and are joined as described below to create the medial divider 13.

The divider blank 44 in FIG. 3 includes a centrally disposed front panel 47 having opposing first and second side-edges 48, 49, top edge 50 and a central panel 41 defined by central fold line 42 and punch-line 43. Central panel 41 is further divided by score 46 opposite fold line 42 to which is foldably connected flap 64, said flap 64 having a distal edge 65 with at least one notch 66 thereon. As best shown in FIG. 5, central panel 41 also has a centrally located hole 69 sized to receive the support pole 25.

Returning then to FIG. 3, foldably connected to first and second side-edges 48, 49, respectively, of front panel 47 are first and second lateral side panels 51, 52 each having a rear fold line 53, 54 opposite side-edges 48, 49, respectively, and an upper edge 55, 56. Foldably connected to upper edges 55, 56 of side panels 51, 52, respectively, are flaps 57, 58, each flap 57, 58 having a locking slot 59, 60 located toward the upper edge 61, 62 of the flap 57, 58. Flaps 57, 58 are cut and separate from panel 93.

Foldably connected to rear edge 53 of first side panel 51 is a securing flap 63.

Foldably connected to rear edge 54 of second side panel 52 is rear panel 67 which has dimensions substantially similar to front panel 47. Rear panel 67 has a receiving slot 68 sized to cooperatively receive the notches 66 of flap 64 when the divider 13 is formed as described below.

Foldably connected to top edge 50 is top panel 93 having a side-edge 103 opposite top edge 50 and a centrally located hole 94 sized to receive support pole 25 (as shown in FIG. 5). Arranged symmetrically about hole 94 are opposing guide slots 95, 96, container openings 97, 98, outside guide slots 99, 100, and retaining slots 101, 102. Foldably connected to side-edge 103 is a securing flap 104.

Tube support blank 45, shown in FIG. 4, includes a centrally disposed pole panel 70 having opposing left and right side-edges 71, 72 and a hole 73 sized to receive support pole 25 (as shown in FIG. 5). Foldably connected to left and right side-edges 71, 72 of pole panel 70 are opposing first panels 74, 75, respectively, each first panel 74, 75 having a score-line 76, 77 opposite side-edges 71 and 72 respectively. Second panels 78, 79 are foldably connected to score-lines 76, 77 of first side panels 74 and 75, respectively. Each second panel 78, 79 has a side-edge 80, 81 opposite score-lines 76, 77 respectively. Foldably connected to second panels 78, 79 at side-edges 80, 81, respectively, are third panels 82, 83. Each third panel 82, 83 has a fold line 84, 85 opposite side-edges 80, 81, respectively. Foldably connected to third panels 82, 83 at fold lines 84, 85, respectively, are end panels 86, 87, each end panel 86, 87 having a distal edge 88, 89 opposite fold lines 84, 85, respectively. Tabs 90, 91 are foldably connected to distal edges 88, 89, respectively.

The medial divider 13 is assembled by folding the divider blank 44 along side-edges 48, 49, and rear edges 53 and 54 such that securing flap 53 overlaps rear panel 67. Securing flap 53 is attached to rear panel 67 by any method common in the art, preferably with an adhesive such as glue. Top panel 93 is then folded along top edge 50 and joined to rear panel 67 by the attachment of securing flap 104. Again, securing flap 104 may be attached to rear panel 67 by any method common in the art, though preferably with an adhesive such as glue. Central panel 41 is folded inward along central fold line 42 and flap 64 folded along score 46 so that the notches 66 of flap 64 interconnect with receiving slot 68 of rear panel 67. If desired, flap 64 may also be attached to rear panel 67 through any method common in the art, such as with the preferred glue.

Next, tube support blank 45 is folded downward at both side-edges 71 and 72, and tabs 90, 91 inserted into guide slots 95, 96, respectively. Tube support blank 45 is inserted until pole panel 70 rests substantially flush against top panel 93 at the same time threading tabs 90 and 91 upward through outside slots 99 and 100 until fold lines 84 and 85 are level with outside slots 99 and 100, respectively. Flaps 57, 58 are then folded inward over top panel 93 such that locking notches 59, 60 align over retaining slots 101 and 102, respectively. Tabs 90 and 91 are then inserted through locking notches 59 and 60, respectively, and engage with retaining slots 101 and 102, respectively. Thus, as can be seen in FIG. 5, hole 73 of pole panel 70 aligns with hole 94 of top panel 93 when the tube support blank 45 is fully inserted and secured to top panel 93. Bag packaging containers 105 and 106 (shown in FIG. 6) are also formed in the divider 13; packaging container 105 being defined by front panel 47, rear panel 67, first panel 74, second panel 78, third panel 82 and container opening 97, and packaging container 106 being defined by front panel 47, rear panel 67, first panel 75, second panel 79, third panel 83 and container opening 98.

To assemble the shipping container and display stand 10 of the present invention for shipping as shown in FIG. 1, lower tray 12 is affixed to base 11 and peripheral panels 31, 32, 33, 34 of lower tray 12 are attached in the upright position thus forming an upward facing retaining wall around the main panel 111 of lower tray 12. Divider 13 is then inserted within the retaining wall such that, as shown in FIG. 5, hole 69 of divider 13 and hole 27 of lower tray 12 are aligned. One or more interconnecting sections of support pole 25, 28 are then inserted through the divider 13, lower tray 12 and into base 11 in order to properly position the divider 13 within the lower tray 12 as well as to retain the divider 13 in place. Thus anchored in base 11 by support pole 25, the medial divider acts as a centrally disposed stabilizing member for the shipping container and display stand.

Preferably, support pole 25 is sized so that when fully inserted into divider 13, lower tray 12 and base 11, its upper end 26 is above central panel 41 and below top panel 93 of divider 13. Upper end 26 of support pole 25 is sized to receive lower end 29 of upper support pole 28.

As shown in FIG. 6, the desired selection of boxes 14 of product are then stacked in rows on either side of the divider 13 within the lower tray 12. The divider 13 should be sized such that it is slightly shorter than the height of the stacked boxes 14. In the shipping configuration shown in FIG. 1, the header board 17 is inserted between divider 13 and either stack of boxes 14, and upper pole 28 is placed on top of divider 13. Optional packaging 18 may also be placed within packaging containers 105, 106. Corner braces 15 are next inserted between the retaining wall of the lower tray 12 and each outer corner 108 of the stacked boxes 14. Finally, cap 16, which is identical in size and shape to lower tray 12, is placed to cover the stacked boxes 14 and corner braces 15 with the peripheral panels forming an upward facing retaining wall around the boxes 14, corner braces 15 and divider 13. The container 10 is then bound for shipment, such as by wire binding 19, straps or plastic wrap (not shown).

The shipping container and display stand is then shipped to the retail location where it is placed in the desired location for display within the retail location. The cap 16 and corner braces 15 are then removed and disposed of, such as by recycling. As described in greater detail below in connection with FIG. 6, the joining members of the peripheral retaining wall are disconnected, the peripheral panels repositioned in the downward position, and joining members re-connected such that a downward facing retaining wall or skirt is formed concealing the base 11 from view. The header device is then assembled and connected to the medial divider and packaging for use by the consumers is placed into a packaging container of the medial divider. Preferably, packaging is placed within a packaging container prior to shipment to the retail location.

Turning then to FIG. 6, the shipping container and display stand 10 of the present invention is shown in the display configuration. In this configuration, cap 16 and corner braces 15 (shown in FIG. 1) have been removed and discarded. Upper pole 28 is inserted through holes 73 and 94 and, as shown in FIG. 5, the lower end 29 of upper pole 28 is connected to the upper end 26 of support pole 25. As shown in FIG. 6, the header board 17 is connected to the upper end 30 of upper pole 28. The joining members of peripheral panels 31, 32, 33, 34 of lower tray 12 are then disconnected and the panels folded from their upright position into a downward position to form a downwardly facing retaining wall or skirt. Corner braces are also removed and discarded or recycled.

The top row of individual boxes 14 are then opened to display the product contained within each box to the consumers. Packaging 18, if not earlier included, is now placed within the packaging containers 105 and 106 so that consumers may take a package and fill it with their desired selection of product from the open boxes 14. As boxes are emptied, they may be removed and the box underneath opened to continue displaying product.

While several embodiments of the present invention have been disclosed, it is to be understood by those skilled in the art that other forms can be adopted, all coming within the spirit of the invention and scope of the appended claims:

We claim:

1. A shipping container and display stand formed from foldable sheet material comprising:

(a) a pallet;

(b) a lower tray affixed atop the pallet, said lower tray having a peripheral retaining wall positionable between a first upright position and a second downward position;

(c) a plurality of boxes of product in stacked, side by side relation recessed within the lower tray;

(d) a plurality of disposable corner braces inserted between the peripheral retaining, wall of the lower tray and the boxes;

(e) a disposable cap covering the stacked boxes and corner braces; and (f) a centrally disposed stabilizing member within the lower tray, said stabilizing member adapted to receive a header device when said shipping container and display stand is in a display configuration, said boxes of product being stacked on both sides of said stabilizing member.

2. The shipping container and display stand of claim 1 wherein the stabilizing member has at least one packaging container.

3. The shipping container and display stand of claim 1 wherein the header device is detachably connected to the stabilizing member.

4. The shipping container and display stand of claim 1 wherein the stabilizing member comprises:

(a) a divider blank, said divider blank comprising:

(i) a centrally disposed front panel having opposing first and second side-edges, a top edge, a central fold line and a punch-line said central fold line and punch-line, said central fold line and punch-line defining a central panel within the front panel, said central panel having a score opposite the fold line in the front panel to which is foldably connected a flap having a distal edge and at least one notch on said distal edge;

(ii) a first lateral side panel foldably connected to the front panel at the first side-edge and a second lateral side panel foldably connected to the front panel at the second side-edge, each lateral side panel having a rear fold line opposite front panel and an upper edge, said upper edge foldably connected to a flap having a locking slot;

(iii) a securing flap foldably connected to the rear fold line of the first lateral side panel, said securing flap capable of joining the first lateral side panel to the rear panel;

(iv) a rear panel foldably connected to the rear fold line of the second lateral side panel, said rear panel having a receiving slot to cooperatively receive the notch of the flap connected to the central panel of the front panel;

(v) a top panel foldably connected to the top edge of the front panel, said top panel having a side-edge opposite the top edge, a centrally located hole and paired opposing guide slots, container openings, outside guide slots and retaining slots arranged symmetrically about the hole; and (vi) a securing flap foldably connected to the side-edge of the top panel, said securing flap capable of joining top panel to rear panel; and (b) a tube support blank having a centrally disposed pole panel having a hole and opposing left and right side-edges, said tube support blank being threaded through the guide slots, outside guide slots, locking slots and connected to the retaining slots such that the pole panel rests substantially flush against the top panel of the divider blank, said tube support blank forming at least one packaging container within the stabilizing member and further comprising:

(i) a first panel foldably connected to each side-edge of the pole panel and having a score-line opposite the pole panel;

(ii) a second panel foldably connected to each score-line of each first panel and having a side-edge opposite the first panel;

(iii) a third panel foldably connected to each side-edge of each second panel and having a fold line opposite the second panel;

(iv) an end panel foldably connected to each fold line of each third panel and having a distal edge opposite the third panel; and (v) a tab foldably connected to each distal edge of each end panel.

5. The shipping container and display stand of claim 1 wherein the pallet further comprises a lower deck and an upper deck joined by a plurality of spacers.

6. The shipping container and display stand of claim 1 wherein the lower tray further comprises a main panel having a centrally disposed hole, a plurality of side-edges, and a peripheral panel foldably connected to each side-edge, each said peripheral panel having joining members which releasably connect with cooperating joining members on adjacent peripheral panels when the peripheral panels are folded at right angles relative to the main panel.

7. The shipping container and display stand of claim 1 wherein the cap further comprises a main panel having a centrally disposed hole, a plurality of side-edges, and a peripheral panel foldably connected to each side-edge, each said peripheral panel having joining members which releasably connect with cooperating joining members on adjacent peripheral panels when the peripheral panels are folded at right angles relative to the main panel.

8. The shipping container and display stand of claim 3 wherein the header device further comprises a support pole having an upper and lower end, said lower end inserted through the stabilizing member and lower tray and into the pallet, and a header board connected to the upper end of the support pole.

9. The shipping container and display stand of claim 8 wherein the support pole comprises a plurality of interconnecting sections of pole.

10. A shipping container and display stand formed from foldable sheet material comprising:

(a) a base;

(b) a lower tray affixed atop the base, said lower tray having a peripheral retaining wall positionable between a first upright position and a second downward position;

(c) a medial divider recessed within the lower tray, said medial divider comprising:

(i) a divider blank, said divider blank comprising:

(A) a centrally disposed front panel having composed first and second side-edges, a top edge, a central fold line and a punch-line said central fold line and punch-line, said central fold line and punch-line defining a central panel within the front panel, said central panel having a score opposite the fold line in the front panel to which is foldably connected a flap having a distal edge and at least one notch on said distal edge;

(B) a first lateral side panel foldably connected to the front panel at the first side-edge and a second lateral side panel foldably connected to the front panel at the second side-edge, each lateral side panel having a rear fold line opposite front panel and an upper edge, said upper edge foldably connected to a flap having a locking slot;

(C) a securing flap foldably connected to the rear fold line of the first lateral side panel, said securing flap capable of joining the first lateral side panel to the rear panel;

(D) a rear panel foldably connected to the rear fold line of the second lateral side panel, said rear panel having a receiving slot cooperatively receive the notch of the flap connected to the central panel of the front panel;

(E) a top panel foldably connected to the top edge of the front panel, said top panel having side-edge opposite the top edge, a centrally located hole and paired opposing guide slots, container openings, outside guide slots and retaining slots arranged symmetrically about the hole; and (F) a securing flap foldable connected to the side-edge of the top panel, said securing flap capable of joining top panel to rear panel; and (ii) a tube support blank having a centrally disposed pole panel having a hole and opposing left and right side-edges, said tube support blank being threaded through the guide slots, outside guide slots, locking slots and connected to the retaining slots such that the pole panel rests substantially flush against the top panel of the driver blank, said tube support blank forming at least one packaging container within the medial divider and further comprising:

(A) a first panel foldably connected to each side-edge of the pole panel and having a score-line opposite the pole panel;

(B) a second panel foldably connected to each score-line of each first panel and having a side-edge opposite the first panel;

(C) a third panel foldably connected to each side-edge of each second panel and having a fold line opposite the second panel;

(D) and end panel foldably connected to each fold line of each third panel and having a distal edge opposite the third panel; and (E) a tab foldably connected to each distal edge of each panel;

(d) a plurality of boxes of product in stacked, side by side relation within the lower tray on both sides of the medial divider; and (e) a header device detachably connected to the medial divider.

11. The shipping container and display stand of claim 10 further comprising:

(a) a plurality of disposable corner braces inserted between the peripheral retaining wall of the lower tray and the boxes; and (b) a disposable cap covering the stacked boxes, medial divider, detached header device and corner braces.

12. The shipping container and display stand of claim 11 wherein the disposable cap comprises a main panel having a centrally disposed hole, a plurality of side-edges, and a peripheral panel foldably connected to each side-edge, each said peripheral panel having joining members which releasably connect with cooperating joining members on adjacent peripheral panels when the peripheral panels are folded at right angles relative to the main panel.

13. The shipping container and display stand of claim 11 wherein the header device further comprises a support pole having an upper and lower end, said lower end inserted through the divider and lower tray and into the base, and a header board connected to the upper end of the support pole.

14. The shipping container and display stand of claim 13 wherein the support pole comprises a plurality of interconnecting sections of pole.

15. The shipping container and display stand of claim 7 wherein the lower tray further comprises a main panel having a centrally disposed hole, a plurality of side-edges, and a peripheral panel foldably connected to each side-edge, each said peripheral panel having joining members which releasably connect with cooperating joining members on adjacent peripheral panels when the peripheral panels are folded at right angles relative to the main panel.

16. The shipping container and display stand of claim 10 wherein the base comprises a pallet.

17. The shipping container and display stand of claim 16 wherein the pallet further comprises a lower deck and an upper deck joined by a plurality of spacers.

18. A method for shipping and displaying an assortment of small products comprising:

(a) assembling a shipping container formed from foldable sheet material, said shipping container comprising:

(i) a pallet;

(ii) a lower tray affixed atop the pallet, said lower tray having a peripheral retaining wall positioned in a first upright position and capable of being positioned in a second downward position;

(iii) a medial divider recessed within the lower tray, said medial divider having at least one packaging container;

(iv) a plurality of boxes of product in stacked, side by side relation within the lower tray on both sides of the medial divider;

(v) a header device capable of being detachably connected to the medial divider placed atop the boxes and medial divider;

(vi) a plurality of disposable corner braces inserted between the peripheral retaining wall of the lower tray and the boxes; and (vii) a disposable cap covering the stacked boxes, medial divider, corner braces and header device;

(b) shipping said shipping container to a retail location;

(c) placing said shipping container in a location for display within the retail location;

(d) removing the disposable cap and corner braces;

(e) connecting the header device;

(f) positioning the peripheral retaining wall of the lower tray in the second downward position thereby concealing the pallet from view; and (g) placing packaging into the packaging container of the medial divider.

19. The method of claim 18 wherein the packaging is placed into the packaging container during the assembling step.

* * * * *